United States Patent [19]

Yan

[11] 4,317,711

[45] Mar. 2, 1982

[54] COPROCESSING OF RESIDUAL OIL AND COAL

[75] Inventor: Tsoung Y. Yan, Philadelphia, Pa.

[73] Assignee: Mobil Oil Corporation, New York, N.Y.

[21] Appl. No.: 186,927

[22] Filed: Sep. 12, 1980

[51] Int. Cl.[3] ..... C10G 1/00

[52] U.S. Cl. ..... 208/8 LE

[58] Field of Search ..... 208/8 LE

[56] References Cited

U.S. PATENT DOCUMENTS

| | | | |
|---|---|---|---|
| 3,396,099 | 8/1968 | Glinka | 208/8 LE X |
| 3,696,027 | 10/1972 | Bridge | 208/251 H X |
| 3,775,303 | 11/1973 | McKinney et al. | 208/210 |
| 3,876,530 | 4/1975 | Frayer et al. | 208/210 |
| 3,882,049 | 5/1975 | Bertolacini et al. | 208/210 X |
| 3,897,329 | 7/1975 | Franz et al. | 208/210 |
| 3,901,792 | 8/1975 | Wolk et al. | 208/210 |
| 3,964,995 | 6/1976 | Wolk et al. | 208/210 |
| 3,985,643 | 10/1976 | Milstein | 208/210 |
| 4,016,067 | 4/1977 | Fischer et al. | 208/210 X |
| 4,052,292 | 10/1977 | Espenscheid et al. | 208/8 LE |
| 4,075,079 | 2/1978 | Lang | 208/8 LE |
| 4,079,005 | 3/1978 | Tan et al. | 208/8 LE X |

*Primary Examiner*—Delbert E. Gantz
*Assistant Examiner*—William G. Wright
*Attorney, Agent, or Firm*—Charles A. Huggett; Michael G. Gilman; Charles J. Speciale

[57] ABSTRACT

This invention provides a method for coprocessing of residual oil and coal which in one embodiment involves the steps of (1) visbreaking a slurry of heavy hydrocarbon oil and finely divided coal; (2) deasphalting the visbroken admixture to provide a solvent-oil fraction and a precipitated asphaltic solids fraction; (3) stripping the deasphalting solvent from the oil fraction to yield demetallized liquid hydrocarbon product; and (4) treating the asphaltic solids fraction under flotation conditions in an aqueous medium to recover a float phase of organic solids product.

11 Claims, 1 Drawing Figure

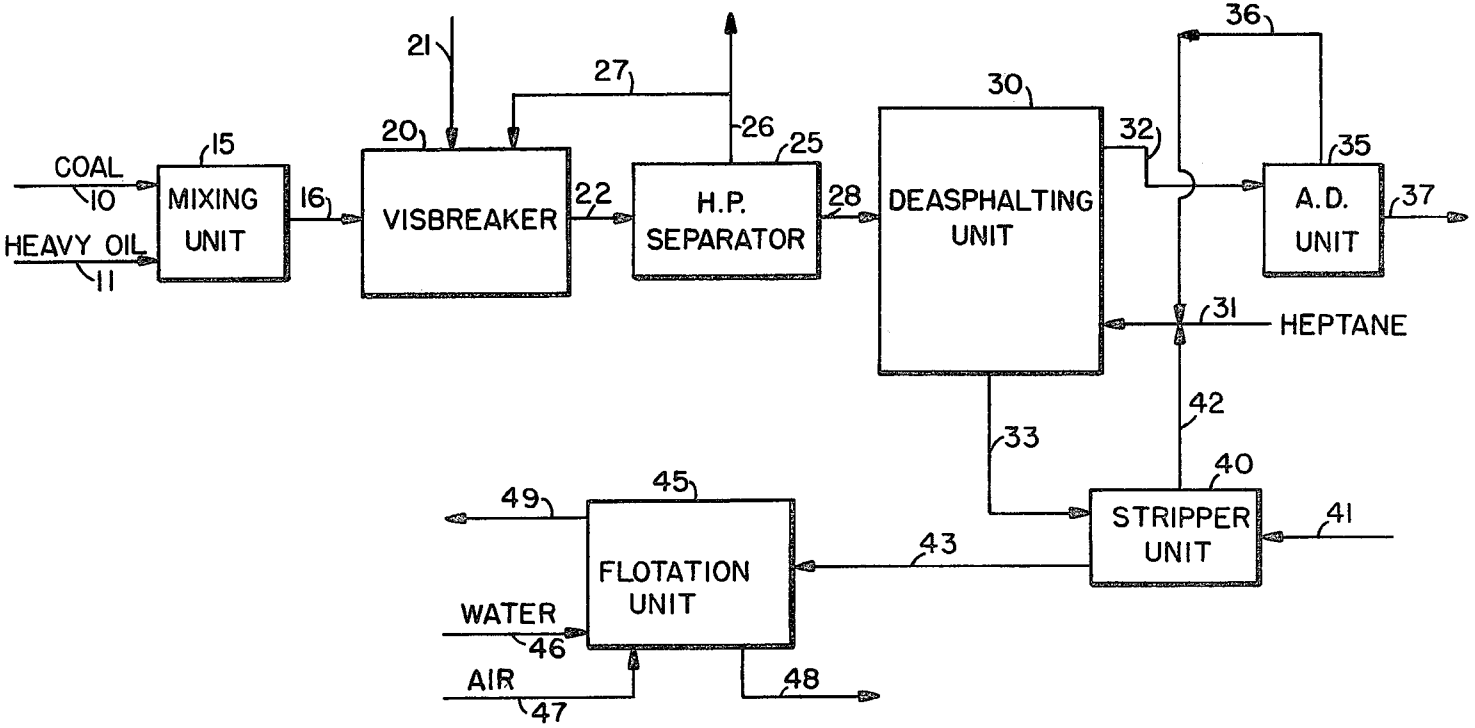
COAL
10
HEAVY OIL
11
MIXING UNIT
15
16
VISBREAKER
20
21
22
27
H.P. SEPARATOR
25
26
28
DEASPHALTING UNIT
30
32
33
A.D. UNIT
35
36
37
HEPTANE
31
42
STRIPPER UNIT
40
41
43
FLOTATION UNIT
45
48
49
WATER
46
AIR
47

COPROCESSING OF RESIDUAL OIL AND COAL

BACKGROUND OF THE INVENTION

Residual petroleum oil fractions produced by atmospheric or vacuum distillation of crude petroleum are characterized by a relatively high metals content. This occurs because substantially all of the metals present in the original crude remain in the residual fraction. Principal metal contaminants are nickel and vanadium, with iron and small amounts of copper sometimes present.

The high metals content of the residual fractions generally preclude their effective use as chargestocks for subsequent catalytic processing such as catalytic cracking and hydrocracking, because the metal contaminants deposit on the special catalysts for these processes and cause the formation of inordinate amounts of coke, dry gas and hydrogen.

It is current practice to upgrade certain residual fractions by a pyrolytic operation known as coking. In this operation the residuum is destructively distilled to produce distillates of low metals content and leave behind a solid coke fraction that contains most of the metals. Coking is typically carried out in a reactor or drum operated at about 800°-1100° F. temperature and a pressure of 1-10 atmospheres. The economic value of the coke byproduct is determined by its quality, particularly its sulfur and metals content. Excessively high levels of these contaminants makes the coke useful only as low-valued fuel. In contrast, cokes of low metals content, for example up to about 100 ppm (parts per million by weight) of nickel and vanadium, and containing less than about 2 weight percent sulfur may be used in high-valued metallurgical, electrical, and mechanical applications.

Presently, catalytic cracking is generally accomplished by utilizing hydrocarbon chargestocks lighter than residual fractions which usually have an API gravity less than 20. Typical cracking chargestocks are coker and/or crude unit gas oils, vacuum tower overhead, and the like, the feedstock having an API gravity from about 15 to about 45. Since these cracking chargestocks are distillates, they do not contain significant proportions of the large molecules in which the metals are concentrated. Such cracking is commonly carried out in a reactor operated at a temperature of about 800°-1500° F., a pressure of about 1-5 atmospheres, and a space velocity of about 1-1000 WHSV.

The amount of metals present in a given hydrocarbon stream is often expressed as a chargestock's "metals factor". This factor is equal to the sum of the metals concentrations, in parts per million, of iron and vanadium plus ten times the concentration of nickel and copper in parts per million, and is expressed in equation form as follows:

$$F_m = Fe + V + 10(Ni + Cu)$$

Conventionally, a chargestock having a metals factor of 2.5 or less is considered particularly suitable for catalytic cracking. Nonetheless, streams with a metals factor of 2.5-25, or even 2.5-50, may be used to blend with or as all of the feedstock to a catalytic cracker, since chargestocks with metals factors greater than 2.5 in some circumstances may be used to advantage, for instance with the newer fluid cracking techniques.

In any case, the residual fractions of typical crudes will require treatment to reduce the metals factor. As an example, a typical Kuwait crude, considered of average metals content, has a metals factor of about 75 to about 100. As almost all of the metals are combined with the residual fraction of a crude stock, it is clear that at least about 80 percent of the metals and preferably at least 90 percent needs to be removed to produce fractions (having a metals factor of about 2.5-50) suitable for cracking chargestocks.

The economic and environmental factors relating to upgrading of petroleum residual oils and other heavy hydrocarbon feedstocks have encouraged efforts to provide improved processing technology, as exemplified by the disclosures of various U.S. Pat. Nos. which include 3,696,027; 3,730,879; 3,775,303; 3,876,530; 3,882,049; 3,897,329; 3,905,893; 3,901,792; 3,964,995; 3,985,643; 4,016,067, and the like.

Accordingly, it is a main object of the present invention to provide an improved method for upgrading heavy hydrocarbon oils for use as liquid fuels or as demetallized feedstocks for refinery cracking operations. Other objects and advantages of the present invention shall become apparent from the accompanying description and illustrated data.

DESCRIPTION OF THE INVENTION

One or more objects of the present invention are accomplished by the provision of a process for heavy hydrocarbon oil demetallation which comprises (1) heating an admixture of heavy hydrocarbon oil and particulate coal under visbreaking conditions; (2) removing a light end fraction and then subjecting the visbroken admixture to solvent deasphalting to provide an oil fraction and a precipitated asphaltic solids fraction; and (3) distilling the said oil fraction to remove the deasphalting solvent and yield a demetallized liquid hydrocarbon product.

In a more particular embodiment, this invention provides a process for heavy hydrocarbon oil demetallation and coal liquefaction which comprises (1) heating an admixture of heavy hydrocarbon oil and particulate coal under visbreaking conditions; (2) removing a light end fraction and then subjecting the visbroken admixture to solvent deasphalting to provide an oil fraction and a precipitated asphaltic solids fraction; (3) distilling the said oil fraction to remove the deasphalting solvent and yield a demetallized liquid hydrocarbon product; and (4) treating the said asphaltic solids fraction under flotation conditions in an aqueous medium to separate a float phase of organic solids product from a sink phase of inorganic ash.

The term "heavy hydrocarbon oil" is meant to include petroleum oil residua and tar sand bitumen feedstocks, in which mixtures at least 75 weight percent of the constituents have a boiling point above about 700° F.

Typically, a heavy hydrocarbon oil suitable for treatment in accordance with the present invention has a metals content of at least 80 ppm, and a Conradson Carbon Residue content of at least 10 weight percent.

The coal component of the invention process can be any of a variety of carbonaceous materials which include bituminous and sub-bituminous types of coal, lignite, peat, and the like. The nominal analysis of typical coals are as follows:

| Sub-Bituminous |
|---|

-continued

| | |
|---|---|
| Sulfur | 0.21% |
| Nitrogen | 0.88 |
| Oxygen | 15.60 |
| Carbon | 65.53 |
| Hydrogen | 5.70 |
| Ash | 3.99 |
| Lignite | |
| Sulfur | 0.53% |
| Nitrogen | 0.74 |
| Oxygen | 32.04 |
| Carbon | 54.38 |
| Hydrogen | 5.42 |
| Ash | 5.78 |

Ball mills or other types of conventional apparatus may be employed for crushing and pulverizing coarse coal in the preparation of the particulate coal feed for the visbreaking step (1) of the process. The crushing and grinding of the coal can be accomplished either in a dry state or in the presence of a liquid such as the heavy hydrocarbon oil being employed in the practice of the invention process. The average particle size of the coal feed is preferably below about 0.25 inches, such as finely divided bituminous coal which has a particle size of less than about 3 mesh (U.S. Sieve Series).

VISBREAKING CONDITIONS

The oil and coal are slurried in a mixing zone and pumped through a visbreaking reaction zone. The weight ratio of heavy hydrocarbon oil to coal is in the range between about 1.5–10:1.

The step (1) visbreaking heat treatment is conducted at a temperature between about 800°–950° F., and at a weight hourly space velocity between about 1–100.

It is preferred that the visbreaking heat treatment is conducted under a hydrogen partial pressure between about 50–2000 psi. Addition of steam to the level of about 0.1–5 weight percent of the combined charge stock is also advantageous.

Demetallation occurs at the incipient temperature of coking for the heavy hydrocarbon oil, i.e., a temperature above about 800° F. The demetallation proceeds rapidly, particularly because the oil is in contact with solid particles. At 800° F. and above thermal conversion of the heavy hydrocarbon oil yields light distillates. Any coke which is coproduced effectively becomes incorporated in the surrounding matrix of coal and ash particles.

Simultaneously, coal depolymerization occurs with the production of gas and liquid constituents. The heavy hydrocarbon oil is a polycyclic aromatic hydrocarbon component which can function as a solvent to convert at least a portion of the coal to liquid constituents.

The visbreaker effluent is passed through a high pressure separator to vent the light end constituents. If hydrogen gas is present, the gas mixture is at least partially recycled to the visbreaking zone. Alternatively, the gas mixture can be fractionated to recover the hydrogen gas for recycle.

SOLVENT DEASPHALTING CONDITIONS

The degassed visbreaker effluent from step (1) is subjected to deasphalting fractionation with a light solvent. It is preferred that the deasphalting zone is a liquid-liquid countercurrent contacting system.

Suitable deasphalting solvents include liquefied normally gaseous hydrocarbons such as ethane, ethylene, propane, propylene, n-butane, isobutane, n-butylene, isobutylene, pentane, and isopentane; cyclohexane; hexane; heptane; decane; octane; nonane; decalin; and mixtures thereof. The yield of liquid products extracted in the deasphalting operation can be increased if a light $C_6$–$C_{16}$ aromatic solvent is employed, e.g., benzene, toluene, xylene, mesitylene, naphthalene, and the like. In general, the deasphalting solvent of choice is a liquid hydrocarbon containing between about 3–12 carbon atoms.

The weight ratio of deasphalting solvent to visbroken admixture in step (2) normally will be in the range between about 0.5–5:1.

The deasphalting treatment in step (2) preferably is conducted at a temperature between about 100°–500° F. and at a sufficient pressure to maintain the deasphalting solvent in liquid form, and for a period between about 0.1–1.5 hours.

The liquid solvent extract phase and the precipitated asphaltic solids are withdrawn separately from the deasphalting zone. The solvent-oil effluent is charged to an atmospheric distillation tower to strip off the deasphalting solvent. The distillation bottom fraction is a demetallized liquid hydrocarbon product. The metals content of the liquid hydrocarbon product is less than about 50 ppm.

The quantity yield of the demetallized liquid hydrocarbon product on the average constitutes between about 45–90 weight percent of the total weight of heavy hydrocarbon oil and coal (m.a.f.) fed into the processing system.

The precipitated asphaltic solids fraction which is recovered tends to be saturated with adsorbed solvent and oil. Preferably the said asphaltic solids fraction is subjected to washing with light solvent or steam stripping to remove the adsorbed liquid and provide residual solids in a substantially dry form.

ASH SEPARATION

Preferably, the stripped asphaltic solids recovered in the manner described above are in the form of a fine powder. In some cases mechanical crushing may be required, depending on the nature of the coal and the processing conditions.

The powdered asphaltic solids are treated under flotation conditions in an aqueous medium to yield a float phase of organic solids product which has been separated from a sink phase of inorganic ash.

The flotation of the organic solids product is facilitated by air-frothing, particularly in combination with flotation aids such as ionic and nonionic surfactants, and the like.

The organic solids product on the average constitutes between about 10–50 weight percent of the total weight of heavy hydrocarbon oil and coal (m.a.f.) fed into the processing system. The organic solids product usually contains between about 5–30 of char and unreacted coal.

Illustrative of the invention process, the drawing is a schematic representation of visbreaking, deasphalting and flotation units in series for coprocessing of heavy hydrocarbon oil and coal, with recovery and recycle of deasphalting solvent to the deasphalting unit.

Referring to the drawing, coal is charged through line 10 and heavy hydrocarbon oil is charged through line 11 into Mixing Unit 15 where they are admixed to form a slurry.

The coal is a High Volatile A bituminous stock which has been ground to a particle size of about 50 mesh. The coal has the following elemental analysis:

Sulfur: 1.33%
Nitrogen: 1.63
Oxygen: 7.79
Carbon: 80.88
Hydrogen: 5.33
Ash: 2.77

The heavy hydrocarbon oil is an Arabian light vacuum residual fraction which has the following analysis:

API, gravity: 8.3
H, wt %: 10.67
S, wt %: 3.93
N, wt %: 0.28
CCR, wt %: 16.13
V, ppm: 68
Ni, ppm: 17
MW: 810

The oil-coal slurry admixture is withdrawn from Mixing Unit 15 and pumped through a preheating unit and passed into Visbreaker Unit 20 via line 16. The weight ratio of oil to coal is about 2:1, and the weight hourly space velocity of the oil-coal is about 20.

Hydrogen is entered into Visbreaker Unit 20 through line 21 to provide a hydrogen partial pressure of about 600 psig in the visbreaking zone at a temperature of about 825°–850° F.

The visbreaker effluent is passed through line 22 to High Pressure Separator 25, where a gaseous fraction is vented through line 26. A portion of the hydrogen-rich gas is recycled to Visbreaker Unit 20 via line 27.

The degassed visbreaker effluent is transferred through line 28 to the top section of Deasphalting Unit 30, where it flows downward in countercurrent contact with heptane which is fed into Deasphalting Unit 30 through line 31.

The weight ratio of heptane to visbroken admixture in the deasphalting zone is maintained at about 3:1, with the temperature being at about 300° F. and the pressure at about 600 psig. The liquid-liquid contact time in the deasphalting zone is about 10 minutes.

A liquid oil fraction of heptane-soluble hydrocarbon constituents exits from the top of Deasphalting Unit 30 and is passed through line 32 to Atmospheric Distillation Unit 35. Heptane is recovered from the distillation column and recycled via line 36 to Deasphalting Unit 30.

Demetallized liquid hydrocarbon product is withdrawn from the processing system via line 37. The liquid hydrocarbon product has a metals content of about 20 ppm, and a CCR weight percent of about 10. The yield of demetallized liquid hydrocarbon product constitutes about 65 weight percent of the total weight of heavy hydrocarbon oil and coal (m.a.f.) fed into the processing system.

Precipitated asphaltic solids are withdrawn from Deasphalting Unit 30 through line 33 and entered into Stripper Unit 40. The asphaltic solids contain small quantities of unreacted coal and inorganic ash.

Steam is fed into Stripper Unit 40 through line 41 to remove residual heptane and oil from the asphaltic solids. The stripped liquid hydrocarbons are recycled through line 42 to Deasphalting Unit 30.

The stripped asphaltic solids are removed from Stripper Unit 40, mechanically crushed to a fine powder and transferred via line 43 to Flotation Unit 45.

Water is supplied to Flotation Unit 45 through line 46, and air is supplied through line 47. A small quantity of No. 2 oil is added to the aqueous medium in Flotation Unit 45 to facilitate the flotation of organic solids product.

An inorganic ash sink phase is withdrawn from Flotation Unit 45 through line 48 and discarded. An organic solids float phase is removed from the processing system via line 49.

The organic solids product constitutes about 30 percent of the total weight percent of heavy hydrocarbon oil and coal (m.a.f.) fed into the processing system. The organic solids product contains less than about 10 weight percent of char and unreacted coal.

What is claimed is:

1. A process for heavy hydrocarbon oil demetallation which comprises (1) heating an admixture of heavy hydrocarbon oil and particulate coal under visbreaking conditions; (2) removing a light end fraction and then subjecting the visbroken admixture to solvent deasphalting to provide an oil fraction and a precipitated asphaltic solids fraction; and (3) distilling the said oil fraction to remove the deasphalting solvent and yield a demetallized liquid hydrocarbon product.

2. A process for heavy hydrocarbon oil demetallation and coal liquefaction which comprises (1) heating an admixture of heavy hydrocarbon oil and particulate coal under visbreaking conditions; (2) removing a light end fraction and then subjecting the visbroken admixture to solvent deasphalting to provide an oil fraction and a precipitated asphaltic solids fraction; (3) distilling the said oil fraction to remove the deasphalting solvent and yield a demetallized liquid hydrocarbon product; and (4) treating the said asphaltic solids fraction under flotation conditions in an aqueous medium to separate a float phase of organic solids product from a sink phase of inorganic ash.

3. A process in accordance with claim 2 wherein the heavy hydrocarbon oil feedstock is a distillation residuum of crude oil.

4. A process in accordance with claim 2 wherein the particulate coal is finely divided bituminous coal.

5. A process in accordance with claim 2 wherein the weight ratio of heavy hydrocarbon oil to coal in the step (1) admixture is in the range between about 1.5–10:1.

6. A process in accordance with claim 2 wherein the step (1) visbreaking heat treatment is conducted at a temperature between about 800°–950° F. under a hydrogen pressure between about 50–2000 psi, and at a weight hourly space velocity between about 1–100.

7. A process in accordance with claim 2 wherein the weight ratio of deasphalting solvent to visbroken admixture in step (2) is in the range between about 0.5–5:1.

8. A process in accordance with claim 2 wherein the deasphalting solvent in step (2) is liquid hydrocarbon containing between about 3–12 carbon atoms.

9. A process in accordance with claim 2 wherein the deasphalting treatment in step (2) is conducted at a temperature between about 100°–500° F. and at a sufficient pressure to maintain the deasphalting solvent in liquid form, and for a period between about 0.1–1.5 hours.

10. A process in accordance with claim 2 wherein the liquid hydrocarbon product recovered in step (3) has a metals content of less than about 50 ppm.

11. A process in accordance with claim 2 wherein air-frothing is employed in the separation of the float and sink phases.

* * * * *